United States Patent [19]

Granetzke

[11] Patent Number: 4,960,169

[45] Date of Patent: Oct. 2, 1990

[54] BAFFLE FOR TUBULAR HEAT EXCHANGER HEADER

[75] Inventor: Dennis Granetzke, Racine, Wis.

[73] Assignee: Modien Manufacturing Co., Racine, Wis.

[21] Appl. No.: 369,626

[22] Filed: Jun. 20, 1989

[51] Int. Cl.[5] ..... F28F 9/02

[52] U.S. Cl. ..... 165/173; 165/174; 165/176

[58] Field of Search ..... 165/176, 173, 175, 174, 165/178

[56] References Cited

U.S. PATENT DOCUMENTS

| | | | |
|---|---|---|---|
| 4,825,941 | 5/1989 | Hoshino et al. | 165/176 |
| 4,829,780 | 5/1989 | Hughes et al. | 165/176 |
| 4,877,083 | 10/1989 | Saperstein | 165/176 |

*Primary Examiner*—Albert W. Davis, Jr.
*Attorney, Agent, or Firm*—Wood, Phillips, Mason, Recktenwald & VanSanten

[57] ABSTRACT

The locating problems of endwise insertion of baffles into tubular heat exchanger headers and/or weakness problems resulting from slotting tubular heat exchanger headers for receipt of baffles are avoided in a heat exchanger including opposed headers 10, 12, at least one of which is a header tube 12 having a plurality of slots 26, 30 in a side thereof. A plurality of generally parallel tubes 14 extend between the headers 10, 12 and enter an associated one of the slots 26, 30, while a baffle is located in the header tube 12 and divides the same into two discrete sections and includes a collar 40 about an end 28 of one of the parallel tubes 14.

4 Claims, 3 Drawing Sheets

FIG. 1
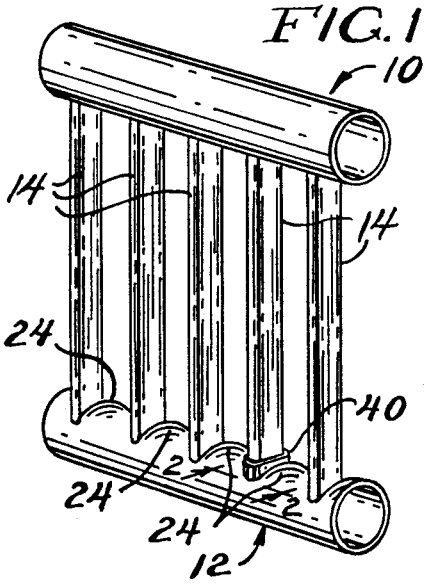
FIG. 2
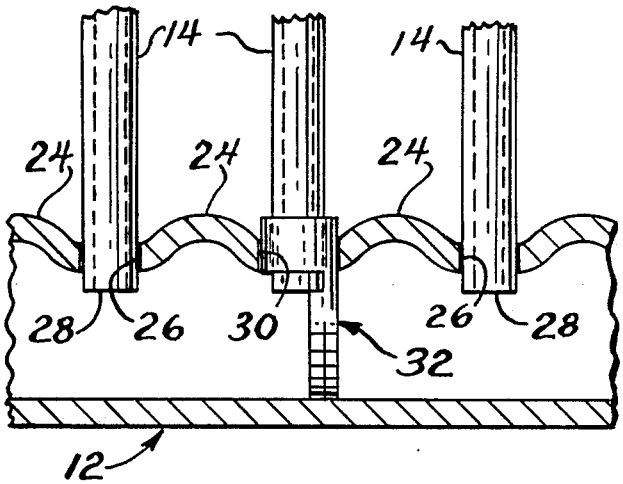
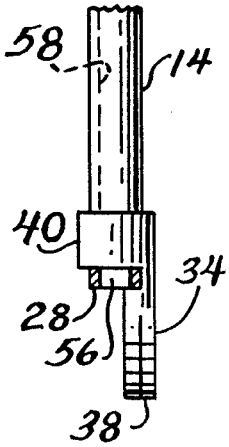
FIG. 6
FIG. 5
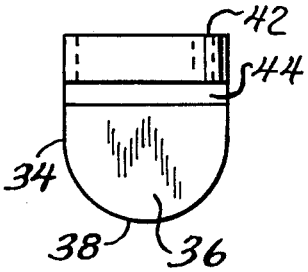
FIG. 4
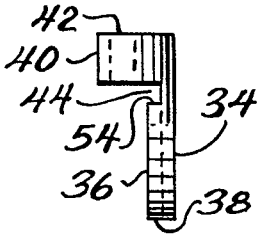
FIG. 3
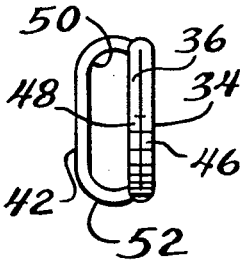
FIG. 7
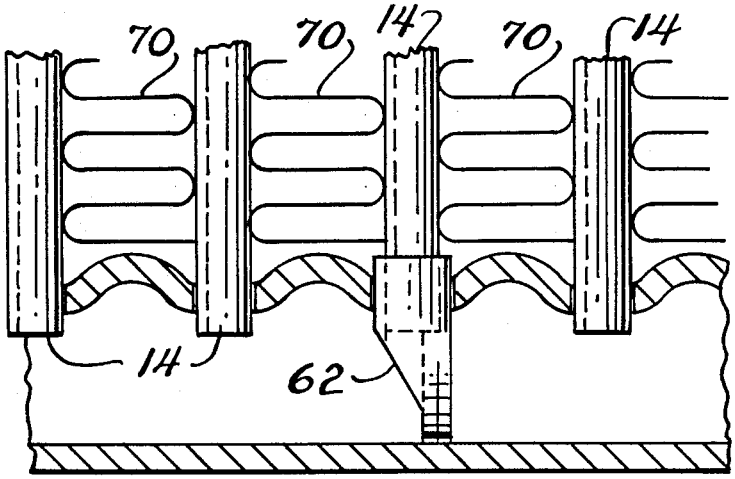

BAFFLE FOR TUBULAR HEAT EXCHANGER HEADER

FIELD OF THE INVENTION

This invention relates to heat exchangers, and more particularly, to baffles located in the headers of heat exchangers to provide for multiple passes of one of the heat exchange fluids.

BACKGROUND OF THE INVENTION

U.S. Pat. No. 4,615,385, issued same assignee as the instant application, illustrates, in FIGS. 1–4 thereof, a highly efficient heat exchanger construction with numerous advantages over those heretofore known in any of a variety of uses. In that heat exchanger embodiment, header plates and separate tanks secured thereto are eliminated in favor of tubular headers which serve as a combination header and tank. The headers are nominally cylindrical and are parallel to one another. Each header includes spaced slots which are adapted to receive respective ends of oval tubes which, in turn, conduct one heat exchange fluid from one header to the other. Without more, flow of such heat exchange fluid is parallel flow; and in many instances, that is all that is required.

However, there are various uses of such a basic heat exchanger structure that require multiple passes of the fluid between the headers. In order to accomplish multiple pass flow within the heat exchanger, one or more baffles are located in one or both of the tubular headers between the ends thereof.

In order to provide interior baffles, some attempts have been made to insert slug or cap-like cylindrical structures into the headers from either end thereof. This approach has not been altogether satisfactory because the baffle must be precisely located prior to the formation of tube-receiving slots in the header, and if not properly located, may obstruct the slot-forming process. Furthermore, to prevent shifting of the baffle once in place, it may be necessary to perform a bonding operation prior to the ultimate bonding operation wherein the tubes are, for example, brazed within the slots in the headers.

To avoid these and other difficulties, other proposals have been advanced. Generally these include forming some sort of a partial, transverse slot across the header at the desired baffle location. This allows the baffle to be inserted into the header and held at precisely the proper location substantially simultaneously with the formation of the entire heat exchanger so that but a single bonding operation need be employed and positive placement of the baffle assured. Furthermore, because the baffle need not be inserted until well after the slot-forming operation, there is no possibility that the baffle will interfere with that operation.

At the same time, this method generally requires that the header periphery be cut through a length equal to an arc length of at least 180°, and frequently more, which in turn can undesirably weaken the header.

The present invention is directed to overcoming one or more of the above problems.

SUMMARY OF THE INVENTION

It is the principal object of the invention to provide a new and improved heat exchanger. More specifically, it is an object of the invention to provide a heat exchanger of the type employing at least one tube as a header and which is provided with at least one baffle.

According to one aspect of the invention, there is provided a heat exchanger which includes opposed headers, at least one of which is a header tube having a plurality of slots in a side thereof. A plurality of generally parallel tubes extend between the headers and enter associated ones of the slots. A baffle is located in the header tube and divides the same into two discrete sections The baffle is defined by a section of a separate tube placed on an end of one of the parallel tubes.

In a highly preferred embodiment of the invention, the baffle defining section is a collapsed tube section and is located in the slot in the header receiving the one parallel tube.

Preferably, the separate tube section includes an open tubular collar attached to the collapsed tube section and separated therefrom by a transverse cut extending partially through the separate tube.

The collar is preferably located in the slot in the header receiving the one parallel tube.

In a highly preferred embodiment, the collar has an internal configuration of substantially the same size and shape as the external configuration of the end of the one parallel tube received therein.

According to another aspect of the invention, there is provided a method of locating a baffle within a tubular header of a heat exchanger having a plurality of spaced, tube-receiving slots. The method comprises the steps of (a) introducing the collapsed end of a tube section separated from the remainder of the section by a transverse slit into a selected one of the slots so that the slit is within the header and part of the remainder is in the one slot, and (b) bonding the tube section in place.

In a preferred embodiment of the method, step (a) is preceded by the step of forming the end to the shape of the interior of the header.

The invention also contemplates that step (a) be preceded by the step of enlarging the one slot to receive the tube section and step (b) be preceded by the step of introducing a tube into the remainder of the tube section and parallel tubes into the slots.

In a highly preferred embodiment of the invention, the step of enlarging includes the step of coining the interior of the header to snugly receive the end of the tube section. Preferably, steps of enlarging and coining are performed with but a single punch or die.

Other objects and advantages will become apparent from the following specification, taken in connection with the accompanying drawings.

DESCRIPTION OF THE DRAWINGS

FIG. 1 is a somewhat schematic, perspective view of a heat exchanger of the type that may employ a baffle made according to the invention;

FIG. 2 is a sectional view taken approximately along the line 2–2 in FIG. 1;

FIG. 3 is a plan view of a baffle structure utilized in the embodiment of FIG. 2;

FIG. 4 is a side elevation of the baffle structure;

FIG. 5 is an elevation taken at right angles to FIG. 4;

FIG. 6 is a fragmentary side elevation showing the baffle structure assembled to a tube;

FIG. 7 is a view similar to FIG. 2 but of a modified embodiment of the invention;

DESCRIPTION OF THE PREFERRED EMBODIMENTS

Figure 11:
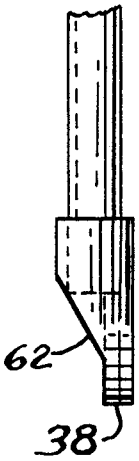
FIGS. 8–11 are views respectively similar to FIGS. 3–6 but of the modified embodiment.
Figure 10:
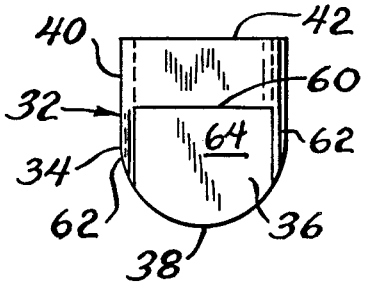
Figure 9:
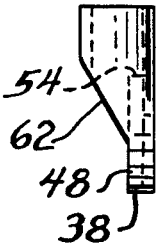
Figure 8:
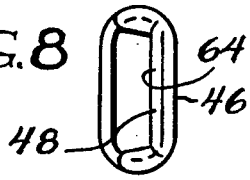

An exemplary embodiment of a heat exchanger made according to the invention is illustrated in FIG. 1 and is generally in the form of that disclosed as the first embodiment of the previously identified U.S. Pat No. 4,615,385, the details of which are herein incorporated by reference. The heat exchanger includes an upper header, generally designated 10, and a lower header, generally designated 12. The headers 10 and 12 are typically formed as essentially cylindrical tubes. So-called "flattened", or oval, cross-sectioned tubes 14 extend between the headers 10 and 12 and are in fluid communication with the interiors thereof. The tubes 14 are parallel to each other and are located in slots in facing sides of the headers 10 and 12, to be described in greater detail hereinafter.

Between each of the tubes 14, each header 10 and 12 is provided with a concave, or partially spherical, dome 24 which provides increased resistance to internal pressure as specified in the previously identified Saperstein, et al., patent.

Turning now to FIGS. 2–6, as can be seen in FIG. 2, between each of the domes 24 there is a slot 26 which receives a respective end 28 of an associated one of the parallel tubes 14. At locations where a baffle is intended to be placed, the slot 26 is replaced with a somewhat larger slot 30 for receipt of a baffle, generally designated 32. As can be ascertained from FIGS. 3–5, each of the baffles 32 is made up of a relatively short piece of tube 34. Each tube piece 34, in turn, is made up of three sections, including a collapsed section 36 at one end 38 of the piece of the tube 34, a collar, or undeformed section 40 at the opposite end 42, and an intermediate, slit section 44 separating the two. In the collapsed section 36, opposite sides 46 and 48 (FIG. 3) of the tube piece 34 are brought into substantial abutment with one another. As can be seen in FIG. 5, the collapsed section 36 is rounded at the end of 38 so as to be sized and shaped as the interior surface of the header 12.

The collar 40 at the opposite end of 42 is less than its original configuration as part of the tube piece 34 and includes an interior surface 50 which is sized and shaped to snugly receive an end 28 of one of the parallel tubes 14, as can be seen in FIG. 6. The exterior surface 52 of the collar 40 is sized to be snugly received in the enlarged slot 30 within the header 12.

The slit 44 is cut through approximately half of the periphery of the tube piece 34 so as to allow the side 48 to be collapsed against the side 46 without distorting the collar 40. The width of the slit 44 may be chosen so as to produce a shoulder 54 facing the collar 40 against which the end 28 of the parallel tube 14 may be abutted. Since the end 38 of the baffle 32 will be abutted against an internal surface of the header 12, the shoulder 54 acts as a stop to control the incursion of the tube 14 into the header 12 so that the opposite end (not shown) of parallel (PV) tube 14 may be properly disposed and located within the header 10.

As can be seen in FIG. 6, the result is an opening 56 from the interior 58 of the parallel tube 14 receiving the collar 40 that will be in fluid communication with the left-hand side of the baffle structure and the interior of the header 12 to that side of the baffle structure.

A modified embodiment of the invention is illustrated in FIGS. 7–11, inclusive, and where like components are employed, like reference numerals are used. Essentially, the baffle piece 32 shown in this embodiment is identical to that just described except that the slit 44, which has a substantial width, is eliminated in favor of a very thin slit 60, which typically will not extend even half the periphery of the short tube piece 34. As a consequence, when the wall 48 is collapsed against the wall 46, the former merges somewhat diagonally, as shown at 62, with a section 64 that is generally planar, to form a somewhat scoop-like configuration. Again, however, a shoulder 54 for positioning purposes is employed.

It is to be noted that in FIG. 7, serpentine fins 70, as will typically be employed, are located between the parallel tubes 14. In some instances, however, so-called plate fins might be used in lieu thereof.

The embodiment illustrated in FIGS. 7-11 has an advantage when utilized in a heat exchanger where substantial pressure differentials may exist across the baffle. In particular, the diagonal sections 62 act as stiffening beads to stiffen the flat sections 64.

While the illustrative embodiments shown in the drawings all employ collapsed tube sections as baffles, the invention contemplates that in some instances the baffle forming tube sections need not be collapsed. For example, one side wall of the tube section could be punched or otherwise opened to its interior and the stops formed by barbs o dimples directed into the interior of the tube section.

Though the use of a separate baffle element (as opposed to forming the collapsed section and slit integrally in one end of one of the tubes 14) would appear to complicate the invention, it has a number of advantages. For one, the telescoping relationship on one of the tubes 14 allows for tolerance variations to be accommodated. For another, each baffle structure can be located in only one of the oversize slots 30 and thus will necessarily be properly positioned during the assembly process.

Figure 12:
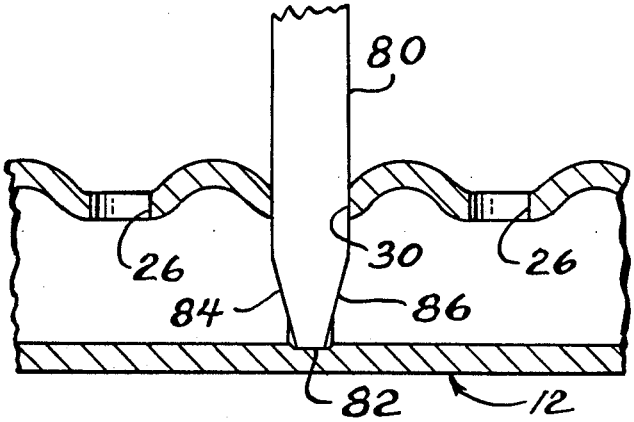
FIG. 12 is a view similar to FIG. 2, taken during part of the fabrication process.
Figure 14:
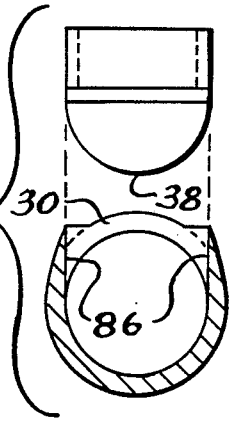
FIG. 14 illustrates a subsequent step in the fabrication of the heat exchanger.
Figure 13:
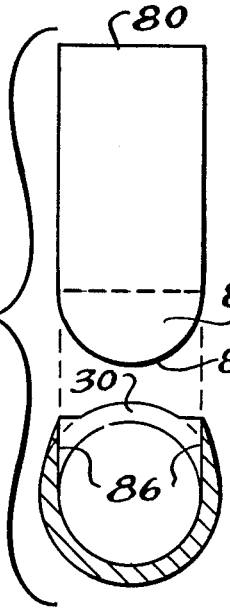
FIG. 13 is a view taken during part of the fabrication process at generally right angles to FIG. 12

Turning now to FIGS. 12, 13 and 14, FIG. 12 illustrates a form of a punch or die 80 that may be utilized in forming the oversize opening 30. An original one of the slots 26 may be used as a pilot for the punch 70; and to this end, the punch 70 may have an end 82 that is narrower than the main body of the punch 80 as a result of tapered sides 84 and 86. Preferably, the end 82 is sized and shaped exactly as the end 38 of any one of the baffles. Consequently, when the punch 80 is moved into the header, the end 82 may be brought into engagement with the interior wall thereof to "coin" the inside surface of the header 12 to match the contour of the ends 38. While this operation is not absolutely necessary, it does give a better fit and minimizes the chance of leakage past the baffle.

FIG. 13 illustrates the presence of relatively parallel end walls 86 on opposite sides of the slot 30 which are spaced a distance equal to the diameter of the interior of the header 12, while FIG. 14 illustrates how such walls will snugly receive one of the baffle structures.

From the foregoing, it will be appreciated that baffle structures made according to the invention avoid the problems that accompany endwise insertion of baffles into tubular headers and, similarly, do not create the weakness in the headers that accompanies providing baffle slots in the headers that extend through at least 180°, and generally more, of the header periphery. Consequently, a highly reliable but simple baffle structure results.

While the invention has been described in terms of single baffle in only one header, it should be appreciated that one or more of the baffles may be placed in either or both of the headers to accommodate any desired number of passes.

What is claimed:

1. A heat exchanger including:

opposed headers, at least one of which is a header tube having a plurality of slots in a side thereof;

a plurality of generally parallel tubes extending slots; and a baffle in said header tube dividing the same into discrete sections and having a collar disposed about an end of one of said parallel tubes.

2. The heat exchanger of claim 1 wherein said collar is additionally located in the slot receiving said one parallel tube.

3. The heat exchanger of claim 1 wherein said baffle is a tube piece having a first section with an internal configuration of substantially the same size and shape as the external configuration as said end of said one parallel tube, a second opposite and collapsed section and a third, open section intermediate said first and second sections.

4. The heat exchanger of claim 3 wherein said parallel tubes and said tube pieces are flattened in cross-section.

* * * * *

UNITED STATES PATENT AND TRADEMARK OFFICE

CERTIFICATE OF CORRECTION

PATENT NO. : 4,960,169

DATED : October 2, 1990

INVENTOR(S) : Dennis Granetzke

It is certified that error appears in the above-identified patent and that said Letters Patent is hereby corrected as shown below:

Column 1, first line under the heading "BACKGROUND OF THE INVENTION", after "issued", insert --October 7, 1986 to Saperstein, et al. and assigned to the--.

Signed and Sealed this

Fifth Day of May, 1992

*Attest:*

*Attesting Officer*

DOUGLAS B. COMER

*Acting Commissioner of Patents and Trademarks*